US007445824B2

(12) United States Patent
Leung et al.

(10) Patent No.: US 7,445,824 B2
(45) Date of Patent: Nov. 4, 2008

(54) CONVERTIBLE/INVERTED TREE

(75) Inventors: Alan Leung, Chai Wan (HK); Yau-Chuen Ng, Chai Wan (HK)

(73) Assignee: Cindex Holdings Limited, Kowloon Bay (HK)

( * ) Notice: Subject to any disclaimer, the term of this patent is extended or adjusted under 35 U.S.C. 154(b) by 0 days.

(21) Appl. No.: 11/592,877

(22) Filed: Nov. 3, 2006

(65) Prior Publication Data

US 2008/0107840 A1 May 8, 2008

(51) Int. Cl.
*A47G 33/06* (2006.01)
*A41G 1/00* (2006.01)

(52) U.S. Cl. ..... 428/20; 428/18; 493/956; 156/61

(58) Field of Classification Search ..... 428/18, 428/20; 156/61; 211/196, 205
See application file for complete search history.

(56) References Cited

U.S. PATENT DOCUMENTS

| | | | | |
|---|---|---|---|---|
| 5,409,745 | A * | 4/1995 | McGuire | 428/18 |
| 6,333,083 | B1 * | 12/2001 | Smedley et al. | 428/8 |
| 6,951,405 | B2 * | 10/2005 | Yao | 362/123 |
| 7,320,816 | B2 * | 1/2008 | Quigel | 428/18 |
| 2004/0161552 | A1 * | 8/2004 | Butts | 428/12 |

* cited by examiner

*Primary Examiner*—John J. Zimmerman
*Assistant Examiner*—Aaron Austin
(74) *Attorney, Agent, or Firm*—Seyed Kaveh E. Rashidi-Yazd, Esq.; Troutman Sanders LLP

(57) ABSTRACT

An invertible decorative tree having sections that are each provided with complementary receiving and associating mechanisms. The sections include a stand, a trunk segment, at least one tree body and a tree top. Through the complementary relationships of the receiving and associating mechanisms, the tree can be arranged to provide a triangular appearance with its apex at the top or its apex near the bottom. In order to provide for this inversion, the tree top must be equipped to connect with the trunk segment or with a tree body segment.

10 Claims, 8 Drawing Sheets

CONVERTIBLE/INVERTED TREE

BACKGROUND OF THE INVENTION

1. Field of the Invention

The present invention relates to artificial decorative trees in general and to a convertible tree in particular.

2. Description of Related Art

Artificial trees for holiday decorations have long since been known in the art. Variations extend to tree stands, the manner in which branches are attached or assembled with the tree, ways trees collapse for storage, prelighting strategies, inclusion of devices to produce changing color or blinking lights, different stands to stabilize the trees, even devices that rotate the entire tree or certain ornaments on the trees.

Recently, certain decorative trees have been made to look like inverted pine trees such that the apex of the triangular shape is at the bottom with the opposing side at the top. This shape is desirable for those wishing for a better way to position and display presents and gifts. In addition, the inverted tree allows for ornaments to hang outside the silhouette of the tree such that their display is enhanced. Whether a user desires an upright or an inverted tree may, however, change over time.

The present invention differs from the above referenced inventions and others similar in that these prior devices do not allow the user to vary the height of the decorative tree while also providing the user the option of inverted or upright tree. Additionally, earlier devices do not offer economies of scale necessary for decorative tree manufacturers that could be obtained by creating a tree that serves the dual purpose of an upright tree and an inverted tree each of variable height.

One objective of the present invention is to provide an attractive inverted tree of variable height;

A second object of the present invention is to provide an attractive upright tree of variable height;

A third objective of the present invention is to provide a tree easily converted from upright to inverted and one wherein height adjustment is available regardless of orientation.

SUMMARY

The present invention is simple in nature. It includes a stand assembly, a trunk segment, at least one tree body assembly and a tree top section. In the preferred embodiment, the tree is prelit and provided with appropriate electrical connections.

The tree of the present invention is convertible from an upright generally triangular shaped tree with an apex at the top to an inverted tree of triangular shape with its apex need the bottom. The height of the tree (in either orientation) can be adjusted by using a trunk segment of varying length or by adding or subtracting the number of tree body assemblies. Each of the tree body assemblies have a plurality of branches graduated in length and arranged on the assembly from shortest to longest.

The trunk segment is associated with the stand assembly. The trunk segment has means to receive; the tree body assembly has means to associate and means to receive; and the tree top section has means to associate and means to receive. In the upright orientation, the means to associate of the tree body assembly is received by the means to receive of the trunk segment. The means to associate of the tree top section is received by the means to receive of the tree body assembly. If additional tree body sections are used, the same arrangement is preferred and the tree bodies are ordered such that the longest branch and the shortest branch, respectively, on a tree body segment are shorter than the longest branch and the shortest branch, respectively, on the next tree body assembly in direct relation with the tree's height.

The inverted tree orientation simply requires each of the tree body assemblies and the tree top section to be reversed in position and direction. Specifically, means to associate of the tree top section is received by means to receive of the trunk segment. Means to associate of the tree body assembly is received by means to receive of the tree top section which results in an inverted triangular shaped tree. If additional tree body assemblies are used, then the means to associate on the tree body assembly having shorter branches is received by the means to receive on the tree body assembly having longer branches. This arrangement continues until the desired number of tree body assemblies are assembled, then the means to associate on the tree top section is received by the means to receive on the uppermost tree body assembly.

In the preferred embodiment, the uppermost point of the tree (whether tree top section or tree body assembly) will be a receiving means. A tree topper ornament such as a star is received by the receiving means.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
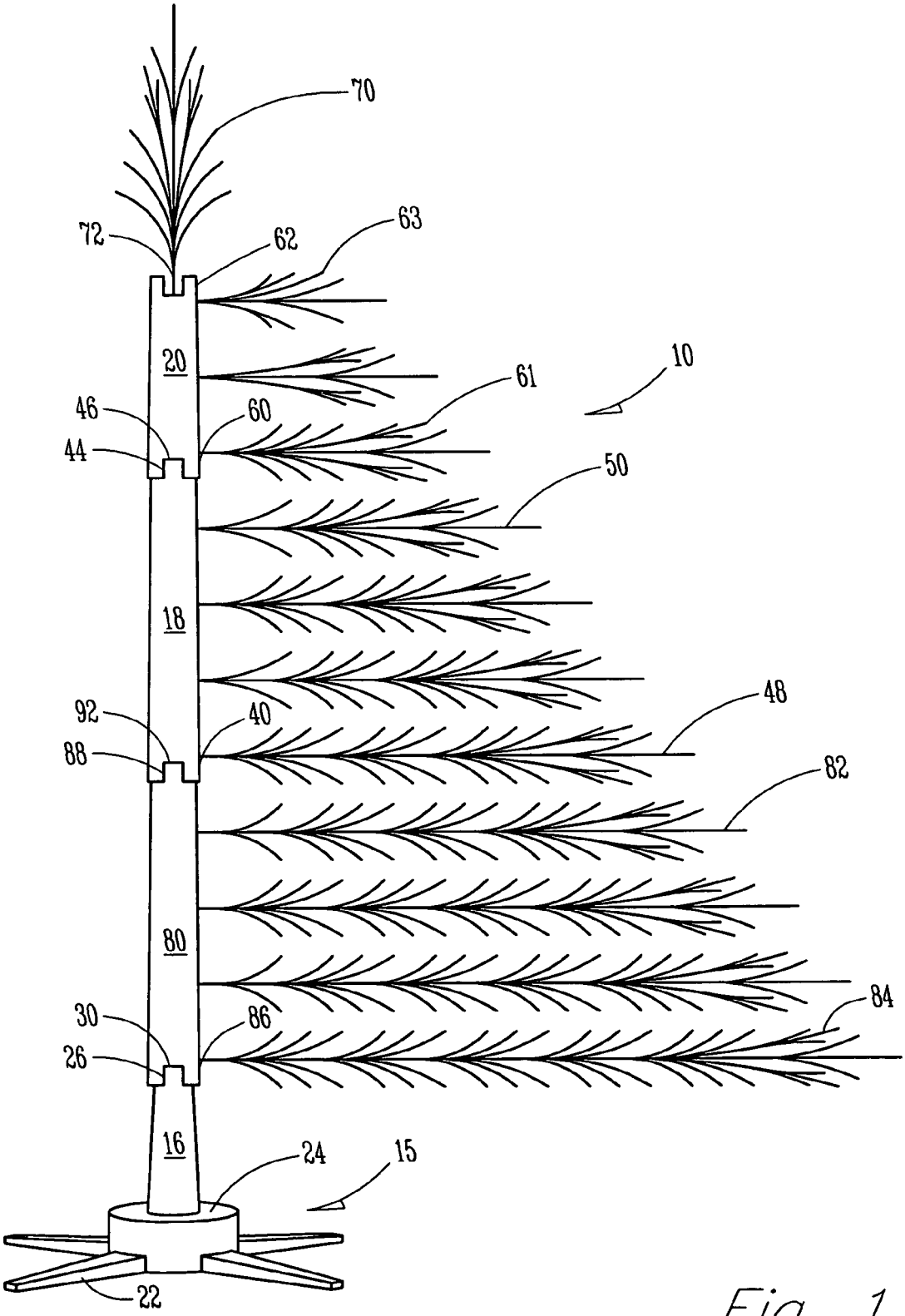
FIG. 1 is a perspective of the upright version of the tree of the present invention.
Figure 2:
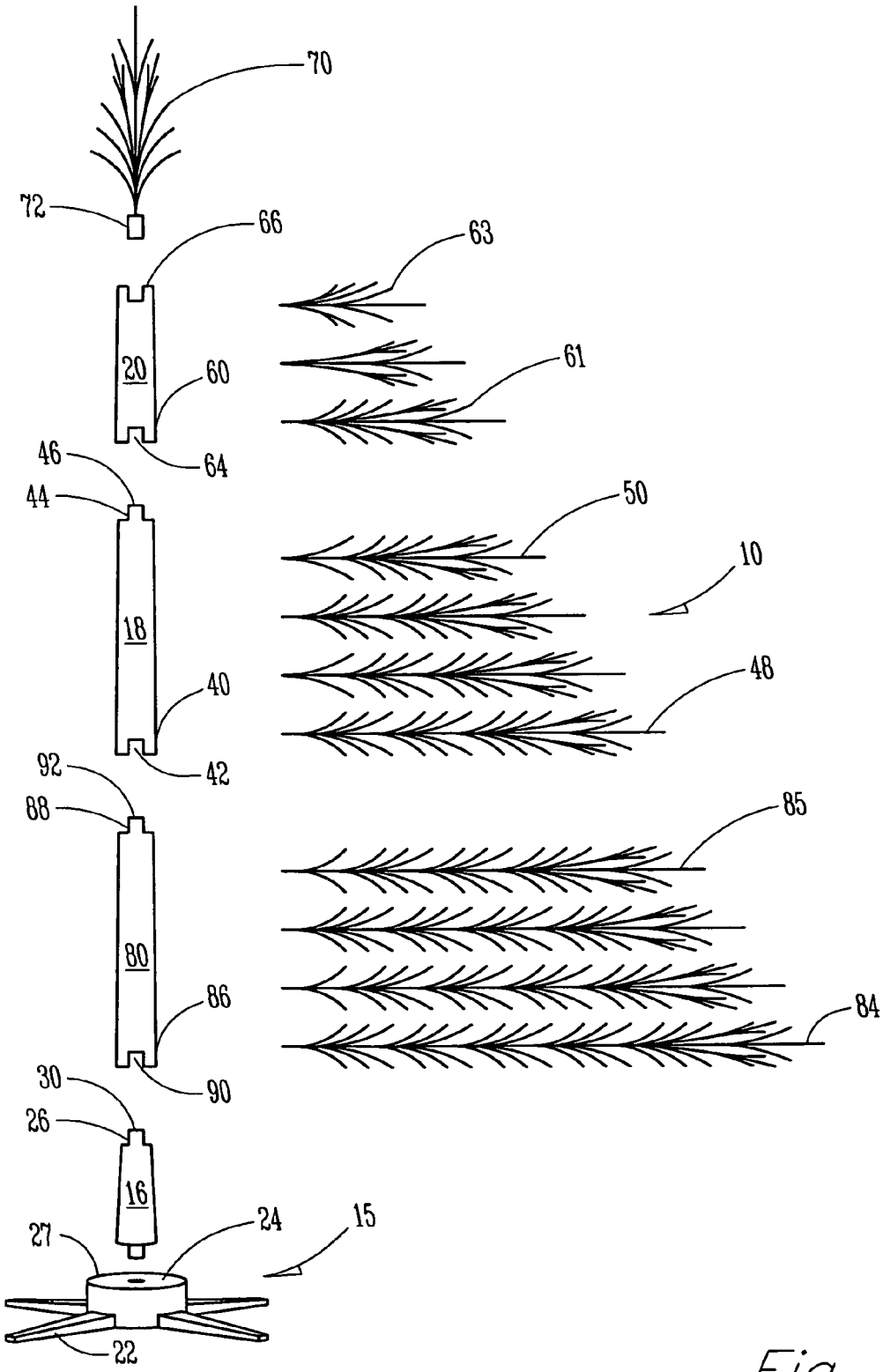
FIG. 2 is an exploded view of FIG. 1.
Figure 3:
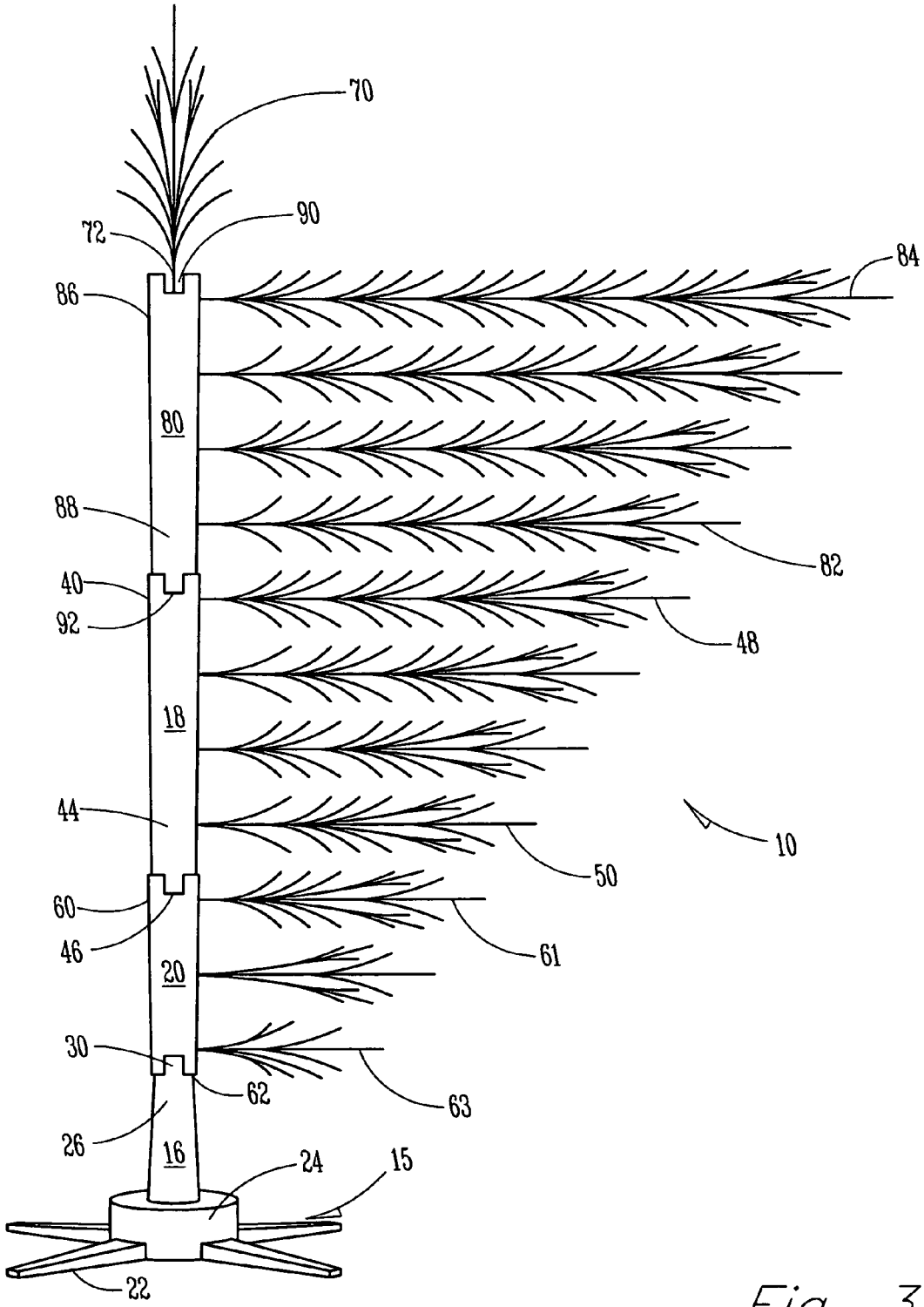
FIG. 3 is a perspective of the inverted version of the tree of the present invention.
Figure 4:
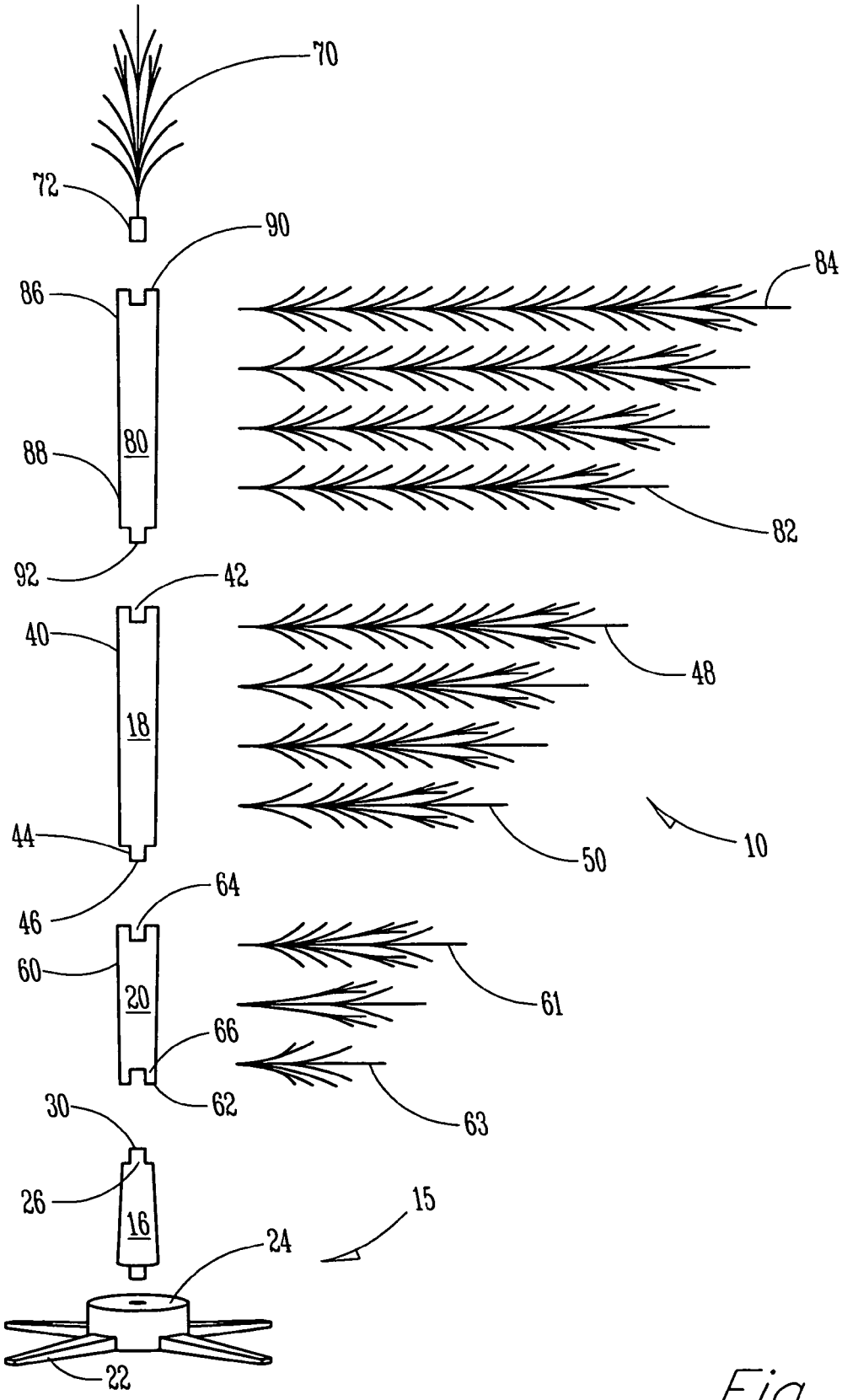
FIG. 4 is an exploded view of FIG. 3.
Figure 5:
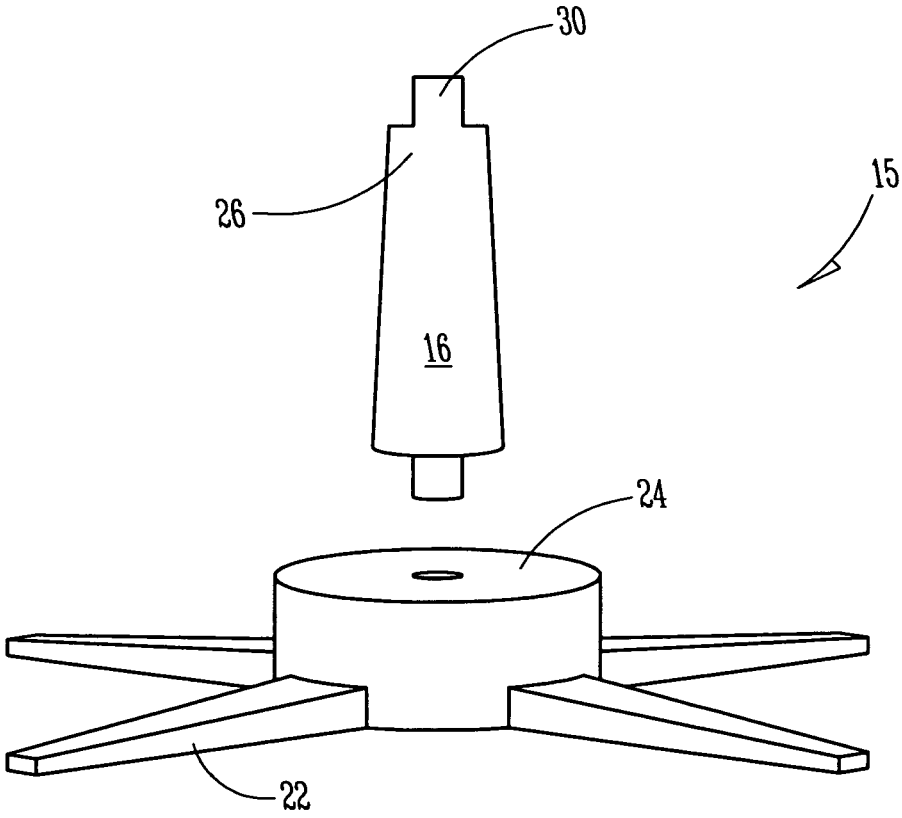
FIG. 5 is a side view of a trunk segment of the present invention.
Figure 6:
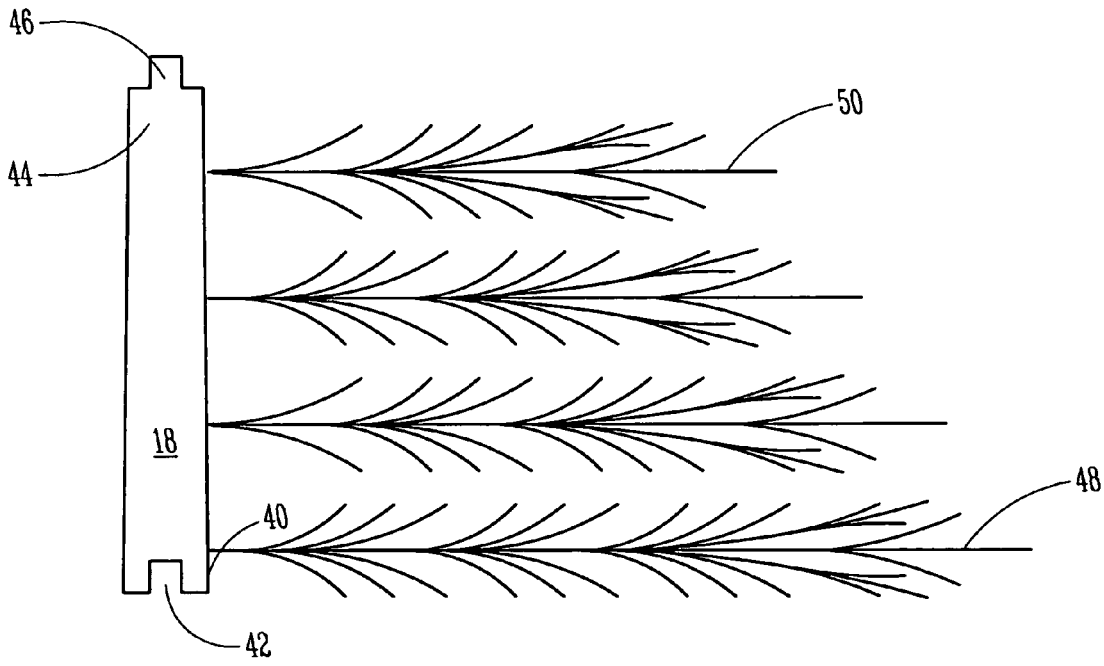
FIG. 6 is a side view of a preferred embodiment of a tree body assembly of the present invention.
Figure 7:
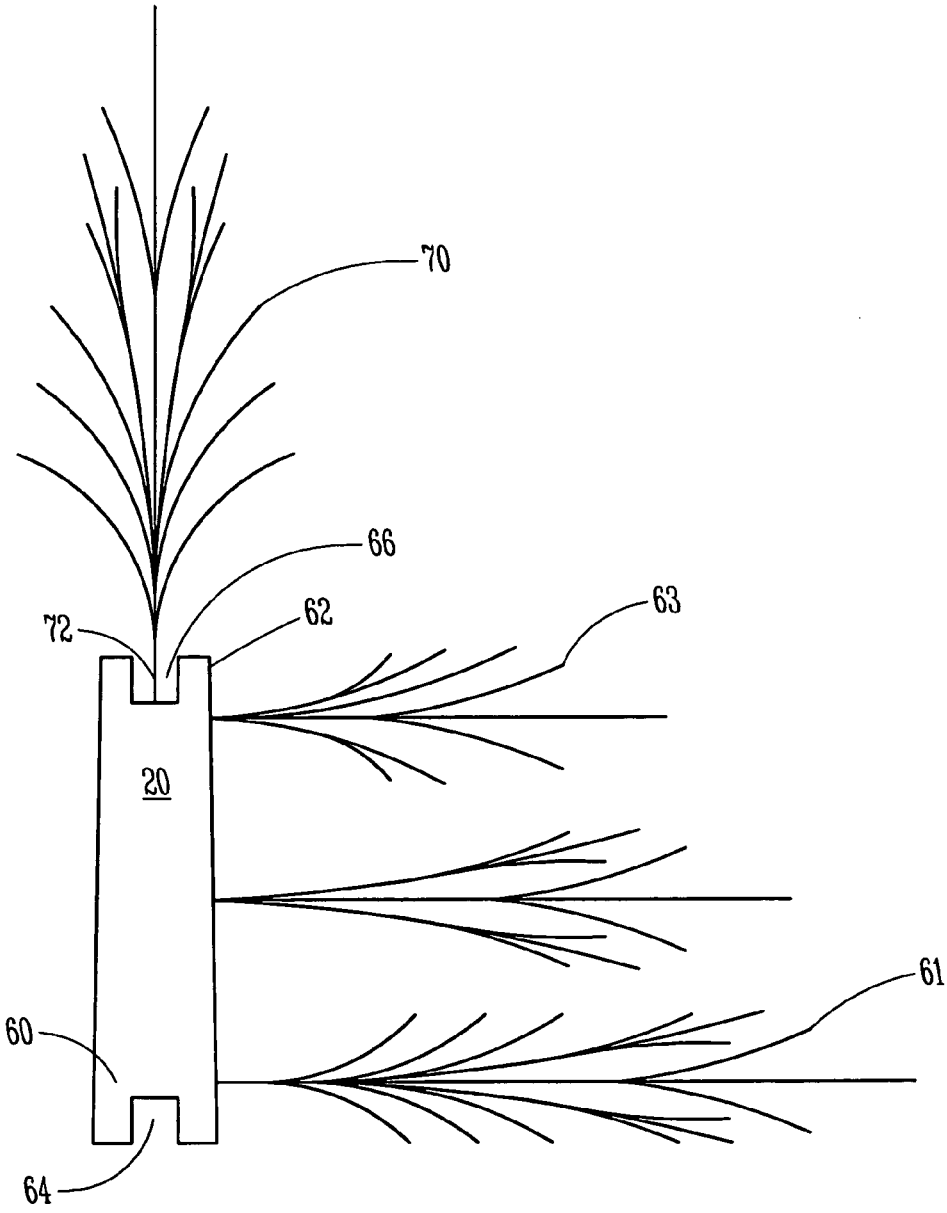
FIG. 7 is a side view of a tree top section of the present invention.

As shown in FIGS. 1 and 3, the tree 10 of the present invention may be converted from upright 12 to inverted 14 using identical and no additional parts.

The tree 10 comprises a stand assembly 15, a trunk segment 16, a first tree body assembly 18, and a tree top section 20. Said stand assembly 15 comprises a plurality of feet 22 and means to receive said trunk segment 24. Said trunk segment 16 comprises a first end 26 and a second end 27 wherein said first end 26 includes means to associate 30. Said first tree body assembly 18 includes a first end 40 having means to receive 42 and a second end 44 having means to associate 46. Said first tree body assembly 18 further comprises a plurality of branches 48, 50 in various lengths arranged between said first end 40 and said second end 44 from shortest 50 to longest 48. Said means to associate 30 of said trunk segment 24 is received by said means to receive 42 of said first tree body assembly 18.

The tree top section 20 comprises a first end 60 and a second end 62 and a plurality of branches 61, 63 of varying length arranged from longest 61 to shortest 63 between said first end 60 and said second end 62, said longest branches 63 being shorter than said longest branches 48 of said first tree body assembly 18. Said first end 60 comprises first means to receive 64, said second end 62 comprises a second means to receive 66. The means to associate 46 of the second end 44 of the tree body assembly 18 are received by the first means to receive 64 of the tree top section 20. An ornament 70 comprising means to associate 72 may be positioned atop the tree 10. Here, said means to associate of the ornament 72 are received by the second means to receive 66 of the tree top section 20.

In the preferred embodiment, a second tree body assembly 80 is included. The second tree body assembly 80 comprises a plurality of branches 82, 84 in various lengths the longest of which is longer than the longest branches 48 on said first tree body assembly 18 and arranged between a first end 86 and a second end 88 from longest 84 to shortest 86. Said first end 86 of the second tree body assembly 80 comprises means to receive 90 and said second end 88 of the second tree body assembly 80 comprises means to associate 92. Said means to associate 92 of said second tree body assembly 80 are received by the means to receive 42 on said first tree body assembly 80. Said means to associate 30 said trunk segment 16 are received by said means to receive 90 on said second tree body assembly 80.

Figure 8:
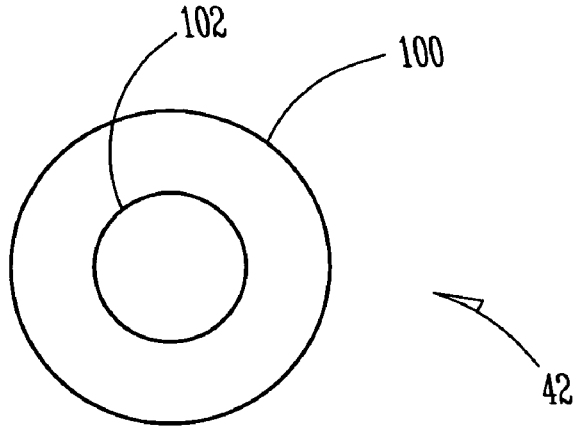
FIG. 8 end views of the means to receive and the means to associate of the preferred embodiment.
Figure 9:
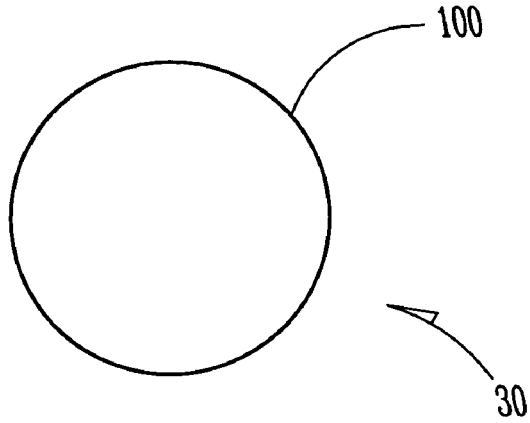
FIG. 9 end views of the tree top-section.

As shown in FIGS. 8 and 9, in the preferred embodiment, said means to receive comprise steel tubing of a first diameter 100 and said means to associate comprise steel tubing having a second diameter 102 smaller than said first diameter and expanding to equal or exceed said first diameter. Therefore, said means to associate and said means to receive are secured by gravity and a friction fit, forming a junction 100. The tree top section comprises two means for receiving and no means for associating for a purpose to be described below.

The inverted tree of FIG. 3 comprises all the same elements, however, the positions of these elements relative to the stand assembly 15 are reversed and each element is inverted from its original orientation. Namely, said second means to receive 66 on said tree top section 20 is positioned to receive said means to associate 26 of said trunk segment 16. Said first means to receive 64 of said tree top section 20 is positioned to receive said means to associate 44 of said first tree body assembly 18. Said means to receive 42 of said first tree body assembly 18 receives said means to associate 92 of said second tree body assembly 80. Said means to receive 90 of said second tree body assembly 80 receives said means to associate 72 of said ornament 70.

The segmented construction of the present invention allows additional tree body assemblies to be purchased to create a larger tree or for a variety of different lengths of trunk segments to be provided thereby creating different distances from the floor as desired by the user. Because the tree can be assembled in either direction, a manufacturer can sell it as either one or the other or as convertible in addition to offering "add on pieces" for height variation.

Thus, the present invention has been described in an illustrative manner. It is to be understood that the terminology that has been used is intended to be in the nature of words of description rather than of limitation.

Many modifications and variations of the present invention are possible in light of the above teachings. For example, means to receive and means to associate could include a variety of complementary mechanics. The tree could include a large number of different decorative aspects including means for alternating colors of lights, different ways of folding or extending branches for storage, etc. The branch lengths on successive tree body assemblies may be arranged to provide a smooth decrease in branch length from lowest to highest or could be selected so that a demarcation or graduated effect between tree body assemblies is visible. Therefore, within the scope of the appended claims, the present invention may be practiced otherwise than as specifically described.

What is claimed is:

1. A decorative artificial tree system comprising:

a stand assembly comprising a base and a plurality of feet, the base comprising a receiving portion;

a tree trunk segment comprising a first end and a second end, both the first end and the second end comprise extending members; and a first tree body assembly comprising a first end and a second end, the first end comprising an extending member and the second end comprising a receiving portion;

a tree top portion comprising first and second ends, both the first and second ends comprise receiving portions;

the receiving portion of the base of the stand assembly sized to receive the extending member of first end of the tree trunk segment, the receiving portion of the second end of the first tree body assembly sized to receive the extending member of the second end of the tree trunk segment, the receiving portion of the second end of the tree top portion sized to receive the extending member of the first end of the first tree body assembly, and the receiving portion of the first end of the tree top portion sized to receive the extending member of the first end of the tree trunk segment enabling inversion of the tree top portion and the first tree body assembly.

2. The tree system of claim 1, further comprising a second tree body assembly, the second tree body assembly comprising a first end comprising an extending member and a second end comprising a receiving portion, the receiving portion of the second end of the second tree body assembly sized to receive the extending member of the second end of the tree trunk segment, and the extending member of the second end of the second tree body assembly receivable by the receiving portion of the second end of the first tree body assembly.

3. The tree system of claim 1, wherein the first tree body assembly further comprises a plurality of branches of varied lengths arranged from shortest to longest, and the tree top portion further comprises a plurality of branches of varied lengths less than or equal to the shortest of the plurality of braches of the first tree body assembly and arranged from shortest to longest.

4. A decorative artificial tree system having a generally triangular shape, the tree system comprising:

a tree top section comprising first and second receiving portions on opposing ends of the tree top section;

a tree body assembly comprising a extending member and a receiving portion on opposing ends of the tree body assembly; and a trunk segment comprising first and second extending members on opposing ends of the trunk segment;

wherein any of the first receiving portion on the tree top section, the second receiving portion on the tree top section, or the receiving portion on the tree body assembly are adapted to receive one of the extending members of the trunk segment or the extending member of the tree body assembly, and the tree system having a generally upright orientation, wherein the lower most point is adjacent the trunk segment and the upper most point is adjacent the tree top section, and the tree system having a generally inverted orientation, wherein the lower most point is adjacent the tree top section and the upper most point is adjacent the tree body portion.

5. The tree system of claim 4, the upright orientation further comprises an apex near the upper most point, and the inverted orientation further comprises an apex near the lower most point.

6. The tree system of claim 4, the inverted orientation comprises an inversion from the upright orientation of the tree top section and the tree body section.

7. The tree system of claim 4, further comprising a stand assembly comprising a plurality of feet and a base comprising an receiving portion, the receiving portion sized to receive one of the extending members of the trunk segment, the stand assembly adapted to stabilize the tree system in both the upright and inverted orientations.

8. The tree system of claim 4, the tree body assembly and the tree top section both comprising a plurality of branches of varied length.

9. A method of converting a decorative tree from an upright orientation to an inverted orientation, the method comprising:

assembling the decorative tree in an upright orientation, comprising:

connecting a first extending member of a trunk segment to a stand assembly;

connecting a second extending member of the trunk segment to a receiving portion of a first tree body assembly; and receiving an extending member of the first tree body assembly with a first receiving portion of a tree top section; and reversing the decorative tree from the upright orientation to the inverted orientation, comprising:

connecting the first extending member of the trunk segment to the stand assembly;

connecting the first receiving portion of the tree top section to the second extending member of the trunk segment; and receiving the extending member of the tree body assembly with the second receiving portion of the tree top section.

10. The method of claim 9, reversing the decorative tree from the upright orientation to the inverted orientation further comprising removing the assembled tree in the upright orientation.

* * * * *